US009570089B2

(12) United States Patent
Bauer et al.

(10) Patent No.: US 9,570,089 B2
(45) Date of Patent: Feb. 14, 2017

(54) HEARING SYSTEM AND TRANSMISSION METHOD

(71) Applicant: SIVANTOS PTE. LTD., Singapore (SG)

(72) Inventors: Patrick Bauer, Koenigslutter (DE); Tim Fingscheidt, Braunschweig (DE); Rosa-Linde Fischer, Erlangen (DE); Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/431,871

(22) PCT Filed: Jun. 12, 2013

(86) PCT No.: PCT/IB2013/054815
§ 371 (c)(1),
(2) Date: Mar. 27, 2015

(87) PCT Pub. No.: WO2014/049455
PCT Pub. Date: Apr. 3, 2014

(65) Prior Publication Data

US 2015/0243298 A1 Aug. 27, 2015

(30) Foreign Application Priority Data

Sep. 27, 2012 (DE) ..... 10 2012 217 632

(51) Int. Cl.
*H04R 25/00* (2006.01)
*G10L 21/038* (2013.01)
*H04R 5/04* (2006.01)

(52) U.S. Cl.
CPC ..... *G10L 21/038* (2013.01); *H04R 5/04* (2013.01); *H04R 25/505* (2013.01); (Continued)

(58) Field of Classification Search
CPC ..... H04R 5/04; H04R 25/505; H04R 25/554; H04R 2205/041; H04R 2225/43; H04R 2225/55; H04R 2460/03; G10L 21/038
See application file for complete search history.

(56) References Cited

U.S. PATENT DOCUMENTS 7,016,510 B2 3/2006 Arndt et al.
7,248,711 B2 7/2007 Allegro et al.
(Continued)

FOREIGN PATENT DOCUMENTS

DE 19525944 A1 1/1997
DE 10261682 A1 7/2004
(Continued)

OTHER PUBLICATIONS

Jax et al. "On artificial bandwidth extension of telephone speech" Signal Processing, Elsevier Science Publishers B.V. Amsterdam, NL, Bd. 83, Nr. 8, Aug. 1, 2003 (Aug. 1, 2003), Seiten 1707-1719, XP004433473, ISSN: 0165-1684, DOI: 1016/S0165-1684 (03) 00082-3 Seite 1707-Seite 1709.

*Primary Examiner* — Brian Ensey
(74) *Attorney, Agent, or Firm* — Laurence A. Greenberg; Werner H. Stemer; Ralph E. Locher

(57) ABSTRACT

A hearing system for improving intelligibility during the holding of a telephone conversation, includes a receiving device for receiving a first signal having first acoustic information and converting the first signal into electrical signals having the first acoustic information, a signal processing device for processing the electrical signals having the first acoustic information into electrical signals having second acoustic information, and an output device for outputting a second signal having the second acoustic information. A method for improving intelligibility during the holding of a telephone conversation using a hearing system is also provided.

9 Claims, 2 Drawing Sheets

(52) U.S. Cl.
CPC ..... *H04R 25/554* (2013.01); *H04R 2205/041* (2013.01); *H04R 2225/43* (2013.01); *H04R 2225/55* (2013.01); *H04R 2460/03* (2013.01)

(56) References Cited

U.S. PATENT DOCUMENTS

| | | | | |
|---|---|---|---|---|
| 8,126,174 | B2 | 2/2012 | Kornagel | |
| 8,929,566 | B2 * | 1/2015 | Kaulberg | G10L 21/038 381/312 |
| 2005/0283263 | A1 | 12/2005 | Eaton et al. | |

FOREIGN PATENT DOCUMENTS

| | | | |
|---|---|---|---|
| DE | 10347212 | B3 | 3/2005 |
| DE | 102008055726 | A1 | 5/2010 |
| EP | 2012557 | A2 | 1/2009 |
| EP | 2211339 | A1 | 7/2010 |

* cited by examiner

HEARING SYSTEM AND TRANSMISSION METHOD

BACKGROUND OF THE INVENTION

Field of the Invention

The present invention relates to a hearing system for improving intelligibility during the holding of a telephone conversation, wherein the hearing system has a receiving device for receiving a first signal having first acoustic information and for converting said first signal into electrical signals having the first acoustic information, a signal processing device for processing the electrical signals having first acoustic information into electrical signals having second acoustic information and an output device for outputting a second signal having the second acoustic information. The invention further relates to a method for improving intelligibility during the holding of a telephone conversation by means of a hearing system.

Here, the term "hearing system" is understood to mean any device that reproduces sound or other stimuli perceivable by the hearing, which can be worn in or on the ear, in particular a hearing aid, a headset, headphones and a system comprising an appliance and a device provided to operate the appliance and the like. In addition, a telephone apparatus should be understood to mean any telephone device, in particular a mobile radio telephone, a cordless telephone, a corded telephone and the like.

Hearing aids are portable hearing apparatuses which are used to supply the hard-of-hearing. To accommodate the numerous individual requirements, different types of hearing aids are provided, such as behind-the-ear hearing aids (BTE), hearing aids with an external earpiece (RIC: receiver in the canal) and in-the-ear hearing aids (ITE), for example also concha hearing aids or channel hearing aids (ITE, CIC). The hearing aids listed by way of example are worn on the outer ear or in the auditory channel. However, bone-conduction hearing aids, implantable or vibrotactile hearing aids are also commercially available. In this case, the defective hearing is stimulated by either mechanical or electrical means.

In principle, hearing aids comprise as essential components an input transducer, an amplifier and an output transducer. The input transducer is normally an acoustic receiver, for example a microphone, and/or an electromagnetic receiver, for example an induction coil. The output transducer is generally implemented as an electroacoustic transducer, for example a miniature loudspeaker or as an electromechanical transducer, for example a bone-conduction hearing aid. The amplifier is usually integrated in a signal processing unit.

The use of a telephone often presents a difficult situation for the wearer of a hearing-aid. In particular, there are difficulties relating to feedback if the wearer of a hearing aid uses a telephone.

Known from publication document US 2005/0283263 A1 is a hearing aid system comprising a hearing aid and a telephone. The telephone and the hearing aid are in wireless connection via a short-range network.

Also disclosed in publication document U.S. Pat. No. 7,248,711 B2 is a method for frequency transposition for a hearing aid or a communication device. The low frequencies are substantially linearly transposed, while the higher frequencies are transposed more and more strongly. For example, higher frequencies can be transposed to lower frequency ranges.

Furthermore, it is known from publication document DE 195 25 944 C2 to generate harmonic oscillations from the input signal by non-linearities in the signal path and to mix these with the output signal in order to increase the ability to distinguish sounds.

The transmission range of conventional telephone systems only covers a frequency range of 300 Hz to 3400 Hz. This results in reduced speech quality in the low-frequency range and in particular impaired intelligibility due to the absence of frequencies in the upper frequency range from above 3400 Hz to typically 7000 Hz.

P. Jax and P. Vary describe a method for artificial bandwidth extension (ABWE) in the article "On Artificial Bandwidth Extension of Telephone Speech" in "Signal Processing", Vol. 83, No. 8, pages 1707 to 1719, 2003.

BRIEF SUMMARY OF THE INVENTION

The object of the present invention consists in the provision of a hearing system that improves intelligibility when used for a normal telephone connection.

The object is achieved by a hearing system according to the invention. The hearing system according to the invention comprises a receiving device for receiving a first signal having first acoustic information and for converting said first signal into electrical signals having the first acoustic information, a signal processing device for processing the electrical signals having first acoustic information into electrical signals having second acoustic information and an output device for outputting a second signal having the second acoustic information. Here, with the hearing system according to the invention, the signal processing device is designed to perform an artificial bandwidth extension of the first signal in that the first acoustic information is supplemented with reference to a model of an origin of the first signal by acoustic information with missing frequency components to form second acoustic information.

The fact that the hearing system according to the invention supplements the first acoustic information with missing frequency components with reference to a model of the origin of the first signal to form second acoustic information and hence approximates the original signal means that intelligibility is advantageously increased. For example a model of human speech and the transmission properties of a telephone system can be used to recognize certain sounds and supplement their signal with the typical frequency components from the non-transmitted frequency range above 3400 Hz and hence improve the detectability of the sounds.

The object is also achieved by a method according to the invention for improving intelligibility during the holding of a telephone conversation by means of a hearing system. The hearing system comprises a receiving device, a signal processing device, an output device and an energy source. The method according to the invention includes receiving a first signal having first acoustic information and converting said first signal into electrical signals having the first acoustic information, processing the electrical signals having first acoustic information into electrical signals having second acoustic information and outputting a second signal having the second acoustic information.

With the method according to the invention, the processing of the electrical signals furthermore includes an artificial bandwidth extension of the first signal in that the first acoustic information is supplemented with reference to a model of an origin of the first signal by acoustic information with missing frequency components to form second acoustic information.

The method according to the invention shares the advantages described with respect to the hearing system according to the invention.

Advantageous developments of the invention are disclosed in the sub claims.

In one embodiment, the receiving device is a microphone, which converts sound into electrical signals.

With a microphone, it is advantageously possible to use the hearing system with any usual telephone apparatus which does not provide any special measures for use with hearing aids.

In one preferred embodiment, the receiving device is a receiving device for electromagnetic fields, wherein the first signal comprises electromagnetic fields and the receiving device is designed to convert the electromagnetic fields having the first acoustic information into electrical signals having the first acoustic information.

In this embodiment, it is advantageously possible to receive acoustic information from a suitable telephone apparatus undisturbed by ambient noise and hence improve the quality of the acoustic information transmitted.

In one possible embodiment, the receiving device is an induction coil, which is designed to receive electromagnetic signals of a telephone device having acoustic information.

The induction coil advantageously enables the hearing system to receive acoustic information from telephone apparatuses, which are already intended for use with hearing aids, without ambient noise.

In one preferred embodiment, the receiving device is designed to receive first signals according to the Bluetooth standard and convert said first signals into electrical signals having the first acoustic information.

An increasing number of telephone apparatuses are provided with a Bluetooth interface in order to enable even those who are not hard of hearing to make telephone calls without obstructive wired connections in the environment of the telephone. This advantageously enables the user to use telephone apparatuses of this kind with the hearing system.

In one preferred embodiment, it is also conceivable for the hearing system to comprise two output devices for outputting the second signal having the second acoustic information for each ear of a wearer.

A binaural supply can advantageously improve the intelligibility of the telephone connection.

In one conceivable embodiment of the invention, the hearing system comprises a transmission device for the wireless transmission of the second signal between the signal processing device and the output device.

Wireless transmission makes it possible to use a telephone connection without a cumbersome wire connection to the output device, which is usually worn on the ear.

It is furthermore conceivable for the signal processing unit and the output device to have separate housings and energy sources.

This advantageously makes it possible, to make the energy source of the output device, which is usually worn on the ear, small and light, since the signal conditioning, which under some circumstances, places a significant load on the processor and hence requires a corresponding power consumption, is separate therefrom. In connection with the wireless transmission, it would, for example, be conceivable to carry the signal processing device in the jacket pocket together with the mobile telephone and follow the telephone conversation via the output devices on both ears.

In one embodiment, it is also conceivable for the hearing system to comprise a recognition device, which is designed to recognize that the first signal is a signal of a telephone conversation and to output a recognition signal, wherein the signal processing is designed to perform the artificial bandwidth extension when the recognition signal is present.

Advantageously, it is hence possible to improve the quality of the intelligibility via the telephone apparatus but simultaneously avoid disruptive artifacts in a normal environment. It is also possible to reduce the power consumption of the signal processing device by means of automatic deactivation of the bandwidth extension and increase the battery lifetime.

BRIEF DESCRIPTION OF THE SEVERAL VIEWS OF THE DRAWING

The present invention is explained in more detail with reference to the attached drawings, which show.

DESCRIPTION OF THE INVENTION

Figure 1:
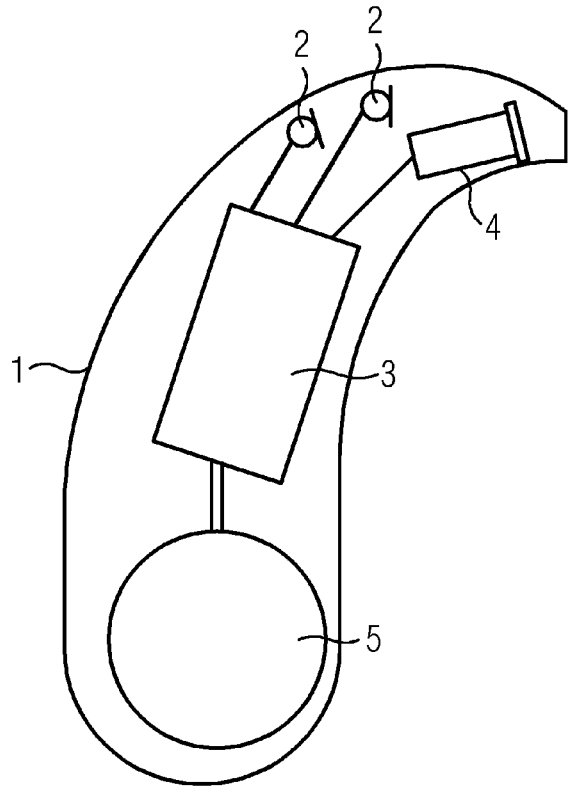
FIG 1 (Prior art)
FIG. 1 a schematic sketch of a hearing aid according to the prior art.

FIG. 1 shows the basic design of a behind-the-ear hearing aid from the prior art. One or more microphones 2 for picking up the noise from the environment are integrated in a hearing aid housing 1 for wearing behind the ear. A signal processing unit 3, which is also integrated in the hearing aid housing 1, processes the microphone signals and amplifies them. The output signal from the signal processing unit 3 is transmitted to a loudspeaker or earpiece 4, which emits an acoustic signal. The sound is optionally transmitted to the eardrum of the person wearing the hearing aid via an acoustic tube fixed to an ear mold in the auditory canal. The energy supply to the hearing aid and in particular to the signal processing unit 3 is provided by a battery 5 which is also integrated in the hearing aid housing 1.

Figure 2:
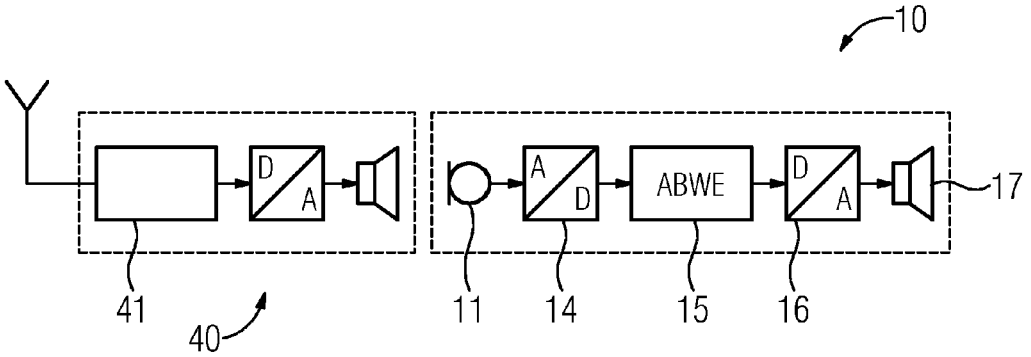
FIG. 2 a schematic representation of the function blocks of one possible embodiment of a hearing system according to the invention.

FIG. 2 shows a possible embodiment of a hearing system according to the invention 10. The hearing system 10 comprises a microphone 11 as a receiving unit for sound waves. The microphone 11 converts the incident sound waves having first acoustic information into electrical signals. The sound source can be an acoustic transmission device 40, for example a telephone with a voice decoder 41. The electrical signals are digitized by an A/D converter 14 and forwarded to a signal processing device 15. It is possible, for example, to use signal processors as the signal processing device 15, but it is also conceivable to use application-specific circuits.

Also conceivable as the receiving unit 11 is a plurality of microphones the signals of which can be combined with each other to achieve a directional effect.

The signal processing device 15 performs inter alia the usual functions for hearing aids such as signal amplification and filtering. Moreover, artificial bandwidth extension (ABWE) takes place. In the case of artificial bandwidth extension, a modeling function for an acoustic signal is provided in the signal processing device 15. The modeling function compares the incoming signal having first acoustic information with a prespecified model for acoustic signals. The modeling function determines a set of parameters, which emulates the first acoustic information with the lowest possible deviation due to the prespecified model. However, other algorithms for the analysis of the first acoustic information are also conceivable. According to the set of parameters determined, the modeling function then generates signal components, which are provided in the acoustic signal according to the prespecified model, but are not contained in the incoming signal having first acoustic information. The signal processing device 15 then emits a second electrical signal with a summation of the incoming first signal having the first acoustic information and the signal components generated by the modeling function.

Modeling functions of this kind are, for example, provided for human speech, but can also relate to other noises, such as for example music. In the case of human speech, it is in this way conceivable for in particular high-frequency components, such as those originally contained in hissing and clicking sounds but not transmitted via telephone, to be supplemented in this way by the signal processing device 15 and hence speech intelligibility in a telephone connection is improved.

The digital electrical second signal having the second acoustic information generated by the signal processing device 15 is then converted via a D/A converter 16 into an analog electrical signal, which is output acoustically via an earpiece 17 as an output device.

Figure 3:
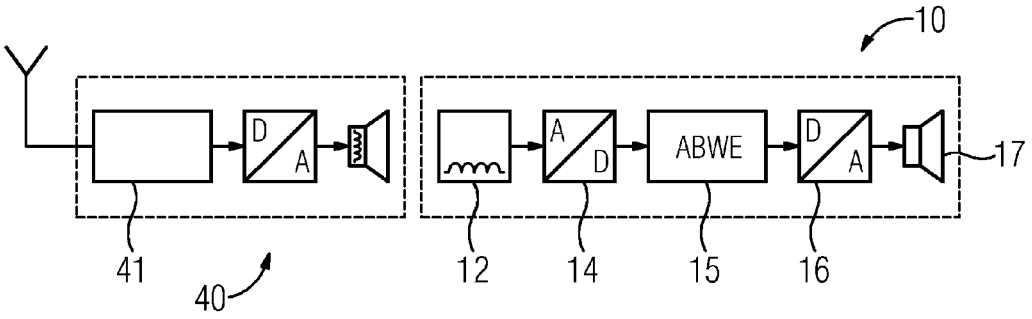
FIG. 3 a schematic representation of the function blocks of one possible embodiment of a hearing system according to the invention.

FIG. 3 shows a conceivable embodiment of a hearing system according to the invention 10. The hearing system 10 comprises an induction coil 12 as receiving unit for a signal having acoustic information. The induction coil 12 is designed to convert an alternating magnetic field that permeates the induction coil 12 and changes the field strength in the rhythm of an acoustic signal having first acoustic information into an electrical signal, which is converted by the A/D converter 14 into a digital electrical signal for the signal processing device 15. The source of the alternating magnetic field can be a transmission device 40, for example a telephone with an induction coil. Otherwise, the embodiment of the hearing system according to the invention in FIG. 3 corresponds to that in FIG. 2.

Figure 4:
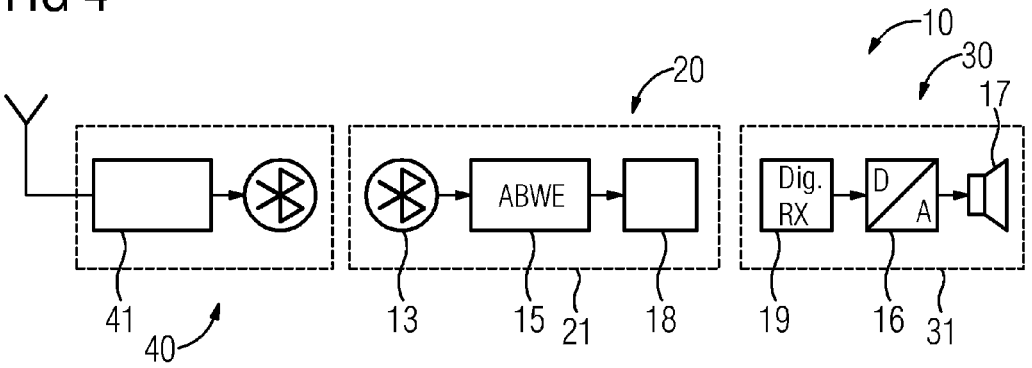
FIG. 4 a schematic representation of the function blocks of a further possible embodiment of a hearing system according to the invention.

FIG. 4 shows a possible embodiment of a hearing system according to the invention 10. The hearing system 10 comprises as a receiving device a Bluetooth interface 13 via which the hearing system 10 can receive a first signal having acoustic information. According to the specifications for the Bluetooth interface 13, this emits a first electrical signal having first acoustic information in digital form to the signal processing device 15 so that an A/D converter 14 can be omitted in this embodiment. The source of the first signal having acoustic information can be a transmission device 40, for example a telephone with a Bluetooth interface. The hearing system 10 furthermore comprises a digital transmission device, which transmits the second signal between the signal processing device 15 and the output device 17 by wireless means. To this end, a transmit unit 18 with a signal connection to the signal processing device 15 and a receiving unit 19 with an electrical signal connection to the earpiece 17 via a D/A converter 16 are provided. The wireless signal transmission enables the hearing system 10 to be divided into a remote unit 20 and an ear unit 30, each with separate housings 21, 31. It is also provided that the remote unit 20 and the ear unit 30 each have a separate energy source even if it is conceivable for wireless power transmission from the remote unit 20 to the ear unit 30 to take place.

The wireless transmission technology is preferably provided by transmission by means of electromagnetic fields in the radio range. This can for example be transmission via a digital transmit-and-receiving unit 18 or 19, optionally according to the Bluetooth standard (in this case, the function blocks 18 and 19 would be correspondingly replaced by Bluetooth interface 13) or even analog transmission via an induction coil 12 instead of the digital receiving unit 19 together with the downstream D/A converter 16 in the ear unit 30 and a transmit coil after the corresponding D/A converter 16 instead of the digital transmit unit 18 in the remote unit 20. It would also be conceivable to have transmission by means of light or ultrasound. Also possible as an ear unit 30 would be a cochlear implant so that the second signal is no longer converted into an acoustic signal but direct nerve stimulation is achieved by the electrical signal.

The division of the hearing system 10 also makes it possible to provide an ear unit 30 for each ear of the wearer. However, it is also conceivable to combine the functions of the remote unit 20 and the ear unit 30 in one ear unit and to transmit the second signal having second acoustic information by wireless means to a second ear unit without a signal processing apparatus 15.

In one preferred embodiment of the hearing system according to the invention 10, it comprises a recognition device 12, 13, which is designed to recognize that the first signal is a signal of a telephone conversation. For example, the Bluetooth interface 13 can signal a corresponding transmission mode. It is also possible to recognize from a signal from the induction coil 12 that transmission is taking place from a suitably equipped telephone receiver. It would also be conceivable for the signal processing device 15 to recognize from the limited spectral bandwidth or other criteria that the first signal contains acoustic information of a telephone conversation. Other recognition mechanisms, such as a magnet in the telephone receiver with a corresponding sensor in the hearing system 10 are also possible.

The recognition device 12, 13 correspondingly signals the type of connection via a signal connection of the signal processing device 15, wherein the signal processing device 15 is designed to carry out or switch off the artificial bandwidth extension accordingly.

Figure 5:
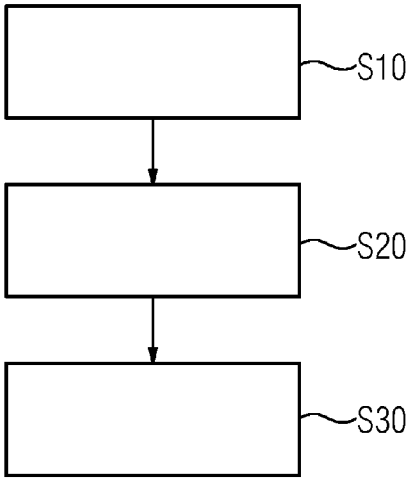
FIG. 5 a flow diagram of a possible method according to the invention.

FIG. 5 is a flow diagram with a possible sequence of a method according to the invention.

In a step S10, the hearing system 10 receives a first signal having first acoustic information and converts said first signal into electrical signals having first acoustic information. In a step S20, the signal processing device 15 processes the electrical signals with first acoustic information into second electrical signals having second acoustic information. This processing includes the artificial bandwidth extension in that the first acoustic information is supplemented with reference to a model of an origin of the first signal by acoustic information with missing frequency components to form the second acoustic information. In a step S30, the second electrical signals are output.

Although the invention was illustrated and described in detail by the preferred exemplary embodiment, the invention is not restricted by the disclosed examples and the person skilled in the art can derive other variations therefrom without departing from the scope of protection of the invention.

The invention claimed is:

1. A hearing system for improving intelligibility during the holding of a telephone conversation, the hearing system comprising:

a receiving device for receiving a first signal having first acoustic information and for converting the first signal into electrical signals having the first acoustic information;

a recognition device configured to recognize that the first signal is a signal of a telephone conversation and to output a recognition signal;

a signal processing device for processing the electrical signals having the first acoustic information into electrical signals having second acoustic information, said signal processing device being configured to perform an artificial bandwidth extension of the first signal by supplementing the first acoustic information with reference to a model of a source of the first signal by acoustic information with missing frequency components to form the second acoustic information, and said signal processing device being configured to carry out the artificial bandwidth extension when the recognition signal is present; and an output device for outputting a second signal having the second acoustic information.

2. The hearing system according to claim 1, wherein said receiving device is a microphone that converts sound into electrical signals.

3. The hearing system according to claim 1, wherein said receiving device is a receiving device for electromagnetic fields, the first signal includes electromagnetic fields and said receiving device is configured to convert the electromagnetic fields having the first acoustic information into electrical signals having the first acoustic information.

4. The hearing system according to claim 3, wherein said receiving device is an induction coil configured to receive alternating electromagnetic fields of a telephone device having acoustic information.

5. The hearing system according to claim 3, wherein said receiving device is configured to receive first signals according to the Bluetooth standard and to convert the first signals into electrical signals having the first acoustic information.

6. The hearing system according to claim 1, wherein said output device is one of two output devices each outputting the second signal having the second acoustic information for a respective ear of a wearer.

7. The hearing system according to claim 1, which further comprises a transmission device for a wireless transmission of the second signal between said signal processing device and said output device.

8. The hearing system according to claim 7, wherein said signal processing device and said output device have separate housings and separate energy sources.

9. A method for improving intelligibility during the holding of a telephone conversation using a hearing system, the method comprising the following steps:

providing a receiving device, a signal processing device, a recognition device, an output device and an energy source;

receiving a first signal having first acoustic information and converting the first signal into electrical signals having the first acoustic information using the receiving device;

using the recognition device to recognize that the first signal is a signal of a telephone conversation and to output a recognition signal;

processing the electrical signals having the first acoustic information into electrical signals having second acoustic information using the signal processing device, carrying out the processing of the electrical signals by performing an artificial bandwidth extension of the first signal by supplementing the first acoustic information with reference to a model of a source of the first signal by acoustic information with missing frequency components to form the second acoustic information, and using the signal processing device to carry out the artificial bandwidth extension when the recognition signal is present; and outputting a second signal having the second acoustic information using the output device.

* * * * *